US007445174B2

(12) United States Patent
Virving

(10) Patent No.: US 7,445,174 B2
(45) Date of Patent: Nov. 4, 2008

(54) REFINING ELEMENT

(75) Inventor: Nils Virving, Hässelby (SE)

(73) Assignee: Metso Paper, Inc. (FI)

( * ) Notice: Subject to any disclaimer, the term of this patent is extended or adjusted under 35 U.S.C. 154(b) by 94 days.

(21) Appl. No.: 10/574,821

(22) PCT Filed: Aug. 20, 2004

(86) PCT No.: PCT/SE2004/001215

§ 371 (c)(1),
(2), (4) Date: Apr. 6, 2006

(87) PCT Pub. No.: WO2005/032721

PCT Pub. Date: Apr. 14, 2005

(65) Prior Publication Data

US 2007/0057102 A1 Mar. 15, 2007

(30) Foreign Application Priority Data

Oct. 6, 2003 (SE) ..... 0302646

(51) Int. Cl.
*B02C 7/12* (2006.01)

(52) U.S. Cl. ..... 241/298; 241/261.3

(58) Field of Classification Search ..... 241/296–298, 241/261.2, 261.3

See application file for complete search history.

(56) References Cited

U.S. PATENT DOCUMENTS

| | | | | |
|---|---|---|---|---|
| 2,035,994 | A * | 3/1936 | Sutherland, Jr. | 241/21 |
| 4,023,737 | A | 5/1977 | Leider et al. | |
| 4,090,672 | A * | 5/1978 | Ahrel | 241/261.1 |
| 5,165,592 | A | 11/1992 | Wasikowski | |
| 5,467,931 | A | 11/1995 | Dodd | |
| 5,690,286 | A | 11/1997 | Dodd et al. | |
| 7,172,148 | B2 * | 2/2007 | Cassidy | 241/261.3 |

FOREIGN PATENT DOCUMENTS

| | | |
|---|---|---|
| FI | 53469 B | 10/1978 |

* cited by examiner

*Primary Examiner*—Mark Rosenbaum
(74) *Attorney, Agent, or Firm*—Lerner, David, Littenberg, Krumholz & Mentlik, LLP

(57) ABSTRACT

Refining elements are disclosed for use in the refining of fibrous material in which the refining elements include a pattern of bars and intermediate grooves between the bars. The bars extend in an arc-shaped direction outwardly over the refining element and the upper surface of the bars includes smaller grooves which form angles of from about 10° to 90° with respect to the longitudinal direction of the bars so that the smaller grooves on the bars extend substantially radially.

2 Claims, 1 Drawing Sheet

REFINING ELEMENT

FIELD OF THE INVENTION

The present invention relates to refiners of the disc-type, which are planar or conical, with opposed refining discs rotating relative to one another. The refining discs are provided with refining elements, which between their opposing faces form a refining gap for the working of fibrous material. The fibrous material is preferably lignocellulosic, and the refiner is used for the manufacture of, for example, reject pulp, recycled fiber pulp and mechanical pulps such as board pulp, thermomechanical pulp (TMP) and chemi-thermomechanical pulp (CTMP) as well as for the low-concentration refining of chemical pulps. More particularly, the present invention relates to a refining element to be used in a refiner of the above kind.

BACKGROUND OF THE INVENTION

A refining element is generally formed with a pattern of bars and intermediate grooves. The bars and grooves are formed in different ways, depending on which fibrous material is to be worked and the degree of working desired and in the case of lignocellulosic material, the pulp quality which is desired. The bars generally have an upper surface and side surfaces such that longitudinal edges are formed between the upper surface and the respective side surface. The bars can, for example, be continuous or discontinuous and arranged in various patterns. The working of the fibrous material is substantially carried out by the bars of the refining elements. The refining gap is formed so that the fibrous material, as seen in the radial direction, passes from the inside outwardly. Farthest inwardly in the refining gap, the refining elements are normally formed to bring about a first disintegration of the material and to advance the material outwardly in the refining gap. A certain defibering, i.e. separation of the fibers of the lignocellulosic material, also takes place in the inner portion of the refining gap, where the distance between the refining surfaces is the greatest. Thereafter this distance decreases outwardly in order that the desired working or refining of the fibrous material can be achieved.

During the refining of fibrous material of high concentration and, above all, at high energy inputs, it has been found necessary to form the outer portion of the refining element with a tight pattern of bars and grooves in order to thereby improve the access to the fibrous material and to bring about an effective working thereof. The bar width in that case can be from about 1 to 2 mm and the groove width can be from about 1.5 to 2 mm. This working at the same time generates a great amount of steam in the refining gap. This gives rise to a high steam pressure in the refining gap. This high steam pressure has a negative effect on the capacity and operational stability of the refiner. This also implies a restriction on the potential energy input. The steam which is developed will, as a result of the tight pattern, be forced up out of the grooves, and will disturb the material flow through the refining gap.

One way of solving this problem would be to supply dilution water to the refining gap in order to thereby condense the steam. This, however, would reduce the material concentration to a low level, and thereby deteriorate the pulp quality.

During the working or refining of fibrous material having a low concentration no steam development takes place, and the material is transported, partly by the liquid flow, out of the refining gap. In this case, a tight pattern of bars and grooves results in the flow through the refining gap being much too low.

SUMMARY OF THE INVENTION

In accordance with the present invention, these and other problems have now been overcome by the discovery of a refining element for use in the refining of fibrous material, the refining element including a refining surface having a pattern of bars and intermediate first grooves having a first width between the pattern of bars, the bars including a pair of side surfaces and an upper surface, and extending in an arcuate shape longitudinally outwardly over the refining surface, the upper surface of the bars including a plurality of second grooves having a second width, the first width being greater than the second width, the plurality of second grooves forming a predetermined angle of from about 10° to 90° with respect to the longitudinal direction of the bars, whereby the second grooves extend substantially radially outwardly with respect to the refining surface. In a preferred embodiment, the plurality of second grooves each extend angularly in the same direct with respect to the bars.

The accordance with the present invention a solution to the above problems is provided. According to the present invention, the bars and grooves have a greater width in order to allow steam transport and, respectively, liquid flow out of the refining gap, at the same time as the upper surfaces of the bars are provided with a plurality of smaller grooves obliquely or across the bars so that they form an angle of from about 10° to 90°, and preferably from about 10° to 70° with respect to the longitudinal direction of the bars. These smaller grooves can be linear, or they can be slightly curved. The smaller grooves are, in one embodiment, open to both side surfaces of the bars. In accordance with this design of the bars, the fibrous material will be worked effectively and at the same time the steam or liquid flow is collected in the grooves between the bars and led out of the refining gap without disturbing the flow of the fibrous material.

The smaller grooves, for example, can be placed along the entire length of the bars or they can be broken off by small portions without grooves, as seen in the longitudinal direction of the bars.

The wide bars, according to the present invention, extend in an arcuate or bow-shaped direction over the refining element, and the small grooves are angularly disposed in relation to the longitudinal direction of the bars.

BRIEF DESCRIPTION OF THE DRAWINGS

The present invention may be further appreciated with reference to the following detailed description, which in turn refers to the drawings, in which.

DETAILED DESCRIPTION

Figure 1:
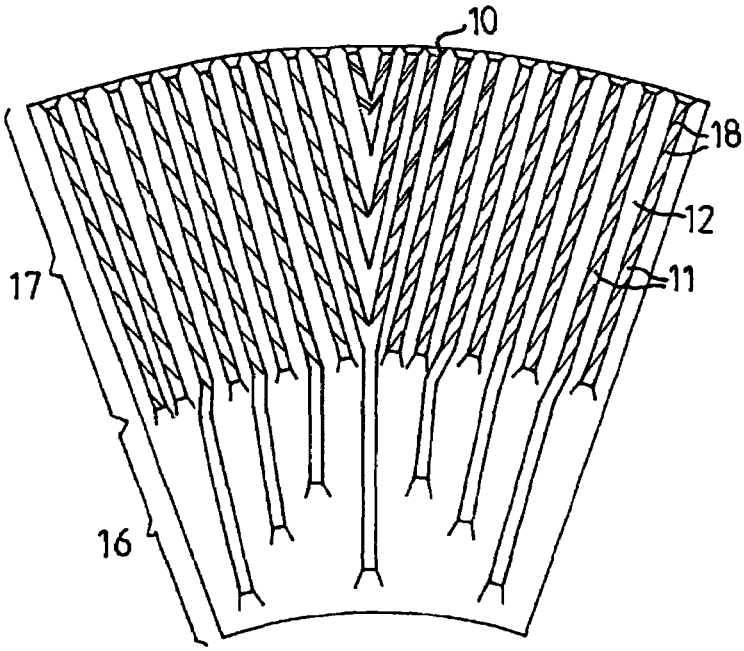
FIG. 1 is a top, elevational view of a refining element in accordance with the present invention.

Referring to the Figures, in which like reference numerals refer to like elements thereof, FIG. 1 shows a refining element 10, which is intended to refine fibrous material having a high concentration. The refining element 10 is provided with a pattern of bars 11 and intermediate grooves 12, where the bars have upper surfaces 13 and side surfaces 14 with edges 15. The pattern is divided into two zones, one inner zone 16 and one outer zone 17, where the bars and grooves in the inner zone are sparser than the bars in the outer zone. The bars in the inner zone are intended to bring about a first disintegration of the fibrous material and to advance the material outwardly to the outer zone. The bars in the outer zone are placed more tightly, which thus provides for more bar edges in order to effect substantial working and refining of the material. The pattern can also comprise more zones where the pattern is usually made tighter from zone to zone, moving radially outwardly.

Due to the bars being provided with oblique smaller grooves 18 on their upper surfaces, the bars as well as the intermediate grooves can be made wider without the working upper surface of the bars losing their effectiveness. These wider grooves yield the result that both the steam and liquid flow in the grooves are simultaneously facilitated, and disturbances in the working of the fibrous material are minimized. The bar width can be from about 3 to 30 mm and the groove width from about 2 to 15 mm with a depth of from about 5 to 15 mm. The deepest grooves are for lower concentration refining.

Figure 2:
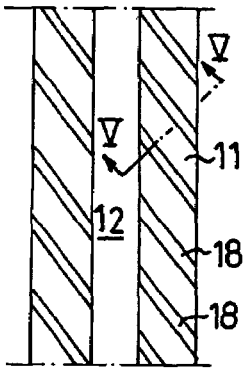
FIG. 2 is a partial, enlarged, top, elevational view of a portion of the bars and grooves in accordance with the refining element of the present invention.

FIG. 2 shows an embodiment of the bars 11 on another refining element according to the present invention. Along the bars 11 a plurality of smaller grooves 18 are placed, which are arranged slightly angularly in relation to the longitudinal direction of the bars, and which can be open to both side surfaces 14. The depth of the smaller grooves should be one or more millimeters, preferably from about 1 to 5 mm. Their width should be from about 0.5 to 2 mm. The distance between adjacent smaller grooves should be from about 1 to 10 mm, preferably from about 2 to 5 mm.

Figure 3:
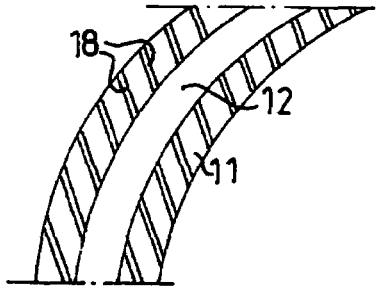
FIG. 3 is a partial, enlarged, top, elevational view of another embodiment of the bars and grooves in accordance with a refining element of the present invention.

In FIG. 3 the bars are arc-shaped and the smaller grooves 18 on the upper surface of the bars are each oblique in relation to the longitudinal direction of the bars. The smaller grooves should thus have a substantially radial direction. As to the design of the smaller grooves (18), the same dimensions apply as in the case with the embodiment of FIG. 2.

Figure 4:
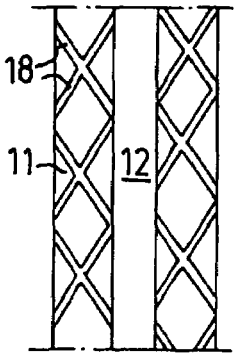
FIG. 4 is partial, enlarged, top, elevational view of another embodiment of a portion of the bars and grooves in accordance with the refining element of the present invention.
Figure 5:
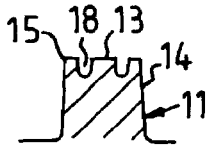
FIG. 5 is a side, elevational, cross-sectional view of a portion of the bars and grooves used in the refining element of the present invention taken along segment V-V of FIG. 2.

According to FIG. 4, the smaller grooves 18 are angular in different directions, preferably in such a way that they cross each other on the upper surface of the bars 11. Alternatively, they can be offset in the longitudinal direction of the bars, so that they do not cross each other. These embodiments permit the direction of rotation of the refining element to be changed. As for the design of the smaller grooves 18, the same dimensions apply as in the case with the embodiment of FIG. 2.

Bars with a design according to the present invention can be placed in any zone on the refining element, but preferably in an outer zone where the working and refining are most intensive, and the distance between opposed refining elements is the shortest, i.e. the refining gap is the smallest and the steam development is the greatest.

During the working of fibrous material with refining elements according to the present invention, the upper surfaces of the bars 11 and the edges of the smaller grooves 18 will work on the material. The steam development arising at high material concentration and the liquid flow passing through the refining gap at low material concentration are led away from the upper surfaces of the bars and can pass out through the grooves between the bars, so that the working of the fibrous material is not disturbed. Thereby, a high capacity can be achieved while maintaining the pulp quality. By designing the refining elements with arc-shaped wide bars 11 with substantially radial smaller grooves 18 on the upper surface, an increased capacity can be obtained. At the same time, a high pulp quality is achieved, in that the smaller grooves bring about an effective fibrillation of the fibrous material.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A refining element for use in the refining of fibrous material, said refining element including a refining surface having a pattern of bars and a plurality of intermediate first grooves having a first width between said plurality of bars, said bars including a pair of side surfaces and an upper surface and extending in an arcuate shape longitudinally outwardly over said refining surface, said upper surface of said bars including a plurality of second grooves having a second width, said first width being greater than said second width, said plurality of second grooves forming a predetermined angle of from 10° to 90° with respect to said longitudinal direction of said bars, so that said second grooves extend substantially radially with respect to said refining surface.

2. The refining element of claim 1 wherein said plurality of second grooves each extend angularly in the same direction with respect to said bars.

* * * * *